United States Patent [19]

Crum

[11] 3,973,886

[45] Aug. 10, 1976

[54] HOT ISOSTATIC PRESS

[75] Inventor: Andrew Stephenson Dalgleish Crum, Warren, Pa.

[73] Assignee: National Forge Company, Irvine, Pa.

[22] Filed: May 6, 1975

[21] Appl. No.: 574,963

[52] U.S. Cl. ..... 425/78; 425/405 H

[51] Int. Cl.[2] ..... B30B 5/02; B30B 11/00

[58] Field of Search ..... 425/78, 405 H

[56] References Cited

UNITED STATES PATENTS

| | | | |
|---|---|---|---|
| 2,423,264 | 7/1947 | Stephens | 137/165 |
| 2,460,774 | 2/1949 | Troutman | 137/165 |
| 2,942,583 | 6/1960 | Rue | 121/46.5 |
| 2,956,577 | 10/1960 | Kirkham | 137/101 |
| 3,363,037 | 1/1968 | Levey et al. | 264/125 |
| 3,419,935 | 1/1969 | Pfeiler et al. | 425/405 H X |
| 3,462,797 | 8/1969 | Asbury | 425/405 H X |
| 3,497,578 | 2/1970 | Glass et al. | 425/405 H X |
| 3,523,148 | 8/1970 | Boyer et al. | 425/405 H X |
| 3,555,597 | 1/1971 | Meadows | 425/405 R |
| 3,571,850 | 3/1971 | Pohto et al. | 425/405 H |
| 3,695,597 | 10/1972 | Lundstrom | 266/2 R |
| 3,741,755 | 6/1973 | Allen | 425/405 H X |
| 3,869,233 | 3/1975 | Witkin | 425/405 H X |
| 3,879,160 | 4/1975 | Miller | 425/405 H |
| R28,301 | 1/1975 | Havel | 425/405 H X |

*Primary Examiner*—J. Howard Flint, Jr.
*Attorney, Agent, or Firm*—Alfred L. Michaelsen

[57] ABSTRACT

A hot isostatic press which includes a mantle interposed between heating elements and the wall of the press and means associated with the press for equalizing the pressure on both sides of said mantle during operation of the press or during pressurization or depressurization.

8 Claims, 3 Drawing Figures

HOT ISOSTATIC PRESS

BACKGROUND OF THE INVENTION

This invention relates to the construction and operation of pressure vessels and, particularly, the construction and operation of hot isostatic presses.

Isostatic presses are used to compress powdered material contained in a mold in order to form a solid article. In the operation of isostatic presses, it is not uncommon to employ pressures as high as 50,000 psi. Frequently, it is desired to isostaticly press a powdered metal. As those skilled in this art appreciate, when isostaticly pressing a powdered metal mold it is often desirable that the powdered metal be pre-heated and that the pressing process occur at an elevated temperature. Presses for conducting such processes are referred to as hot isostatic presses and generally include heating elements for maintaining a high temperature within the press.

In a hot isostatic press, it is obviously desirable that heat generated by the heating elements be employed to maintain at a high temperature the article to be compressed. Stated otherwise, to the extent possible it is desirable to isolate the heating elements from the walls of the press thereby avoiding heat loss. In an effort to thermally isolate the heating elements from the walls of a hot isostatic press, it is conventional to employ one or more heat insulating sheaths or mantles. Such mantles are generally in the form of cylindrical shells which surround the heating elements and are interposed between the heating elements and the walls of the press. For a number of reasons, the structural strength of such a sheath or mantle is generally not substantial. Additionally, the size of such mantles may be considerable, for example a typical mantle may have an inner diameter of 2 feet and a length of 5 or 6 feet.

Because of the size and construction of a mantle, it is particularly susceptible to failure as a result of any pressure differences which may exist across the mantle.

In prior art hot isostatic presses, a single port is provided for pressurizing and depressurizing. Such a single port will generally provide fluid communication with the interior of the press, on one side of the mantle. Generally, means are then provided for insuring fluid communication with the other side of the mantle. For example, in U.S. Pat. No. 3,695,597, a pressurization/-depressurization port is provided and is in communication with the annular space defined by the wall of the press and the outer surface of a heat insulating sheath or mantle. The heat insulating sheath, in this construction, is secured to the upper part of the press and the lower part of the sheath terminates at a point above the bottom of the press whereby the pressurizing medium, which in the case of the hot isostatic pressing process is generally a gas, may flow around the bottom of the sheath into the interior or working area of the press.

Although prior art hot isostatic presses generally provide some means for fluid communication between the outside and the inside of the mantle, nevertheless it has been found that during severe pressure changes, for example during depressurization, a pressure differential may be created across the mantle thus causing a structural failure of the mantle. This invention provides a method and an apparatus, including a novel sub-combination, which prevents the occurrence of such a pressure differential thus insuring that a structural failure of the mantle will not occur during either pressurization or depressurization of an isostatic press.

Summary of the Invention

A hot isostatic press, including heater elements and a mantle, is provided with two fluid communication ports, one port communicating with the annular space between the mantle and the vessel wall and the other port providing fluid communication with the interior of the press. The two ports are piped to either one of two, three port valves. One valve is used for pressurization and the other for depressurization. In each valve, a piston is disposed within a bore and the ends of the piston are exposed to extensions of the bore which, through the ports of the valve body, are in fluid communication with the press. In the center of the valve body there is provided a third port. Thus, in the depressurization valve, fluid from the press enters the valve body through the inlet ports and flows around the piston, between the walls of the piston and the wall of the valve body, and discharges from the valve body through the outlet port. If there is a pressure difference existing in the press and across the mantle, the pressure difference will cause the piston to move, within the valve body, toward the port having the lowest pressure. In this manner, the axial flow path along the piston, from the low pressure port to the outlet port, will be increased while the axial flow path, along the piston, from the high pressure port to the outlet port will be reduced. Thus, the pressure at the high pressure port will be reduced and the pressure at the low pressure port will be increased until the two pressures are equalized.

In the preferred embodiment of the pressurization valve, chambers are provided at the end of the valve body bore and the ends of the piston extend into such chambers. Additionally, the center portion of the piston has a reduced diameter. During pressurization, the pressurization fluid flows through the inlet valve and then outwardly over opposite extensions of the piston, i.e. between the piston wall and the wall of the valve body. Flow of the pressurization fluid through this restricted annular area results in a pressure drop, the magnitude of which is determined by the extent of the axial flow path along the piston wall. The piston is slidably disposed within the valve body and moves in response to any pressure differences existing between the aforesaid chambers. Thus, if the pressure in one of the chambers is higher than in the other, the piston will move in the direction of the low pressure chamber, thereby decreasing the axial length of the flow restrictive path between the inlet port and the low pressure outlet port. As a result, the pressure at the low pressure outlet port will increase and the pressure at the high pressure outlet port will decrease.

DESCRIPTION OF PREFERRED EMBODIMENTS

Figure 1:
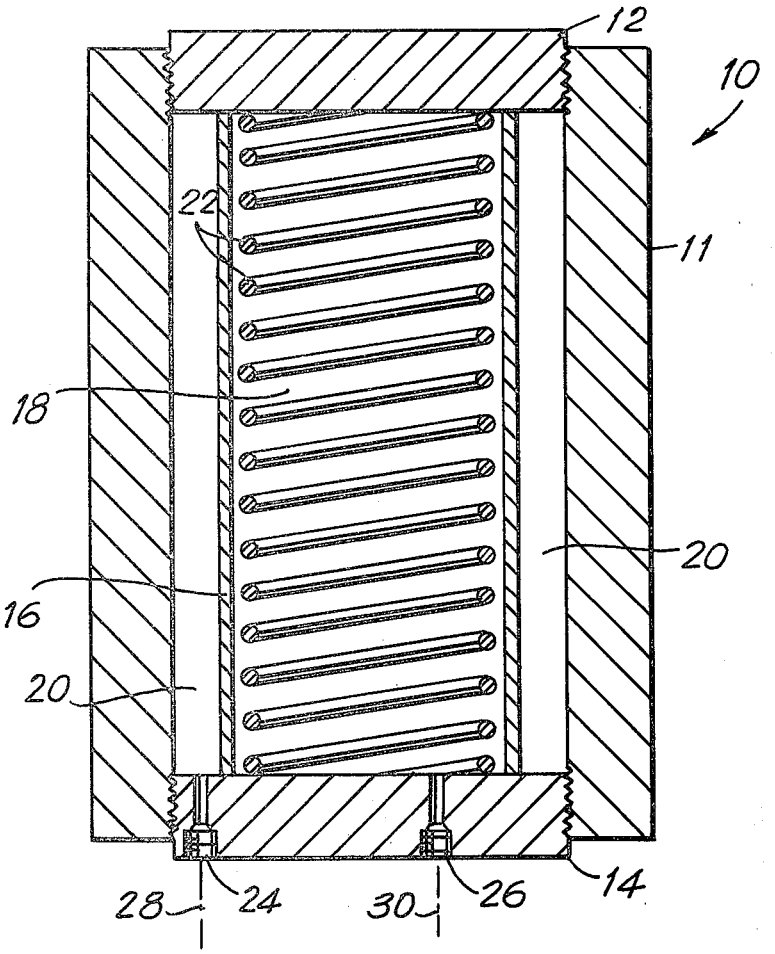
FIG. 1 shows a diagramatic view, in section, of a hot isostatic press.

FIG. 1 shows a diagramatical view, in section, of a hot isostatic press generally indicated by the reference number 10. As shown, the press 10 is comprised of a cylindrical body member 11 having end closure means 12 and 14 which may be secured to the body portion 11 by threads or other appropriate means. Disposed within the vessel 10 is a heat insulating sheet or cylindrical mantle 16 which defines a work area 18 and an annular area 20. Disposed within the work area 18 and adjacent to the mantle are a plurality of heating elements 22.

Those skilled in the isostatic pressing art will appreciate that the mantle 16 may be provided with various types of means for providing fluid communication between the work area 18 and the annular area 20. For example, the mantle may be perforated or, alternatively, one end of the mantle may terminate at a point removed from the end of the press. Since such design features are well known to those skilled in the isostatic pressing art, these features have not been shown in FIG. 1.

In accordance with the present invention, the press 10 is provided with two fluid communication ports, for example the fluid communication ports 24 and 26 which extend through the bottom closure member 14 and provide fluid communication with the annular area 20 and the work area 18, respectively.

Figure 2:
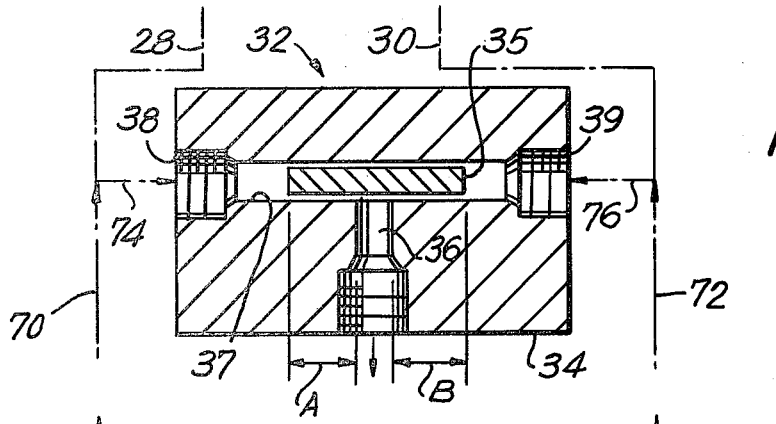
FIG. 2 shows a cross sectional view of a preferred form of a depressurization valve.
Figure 3:
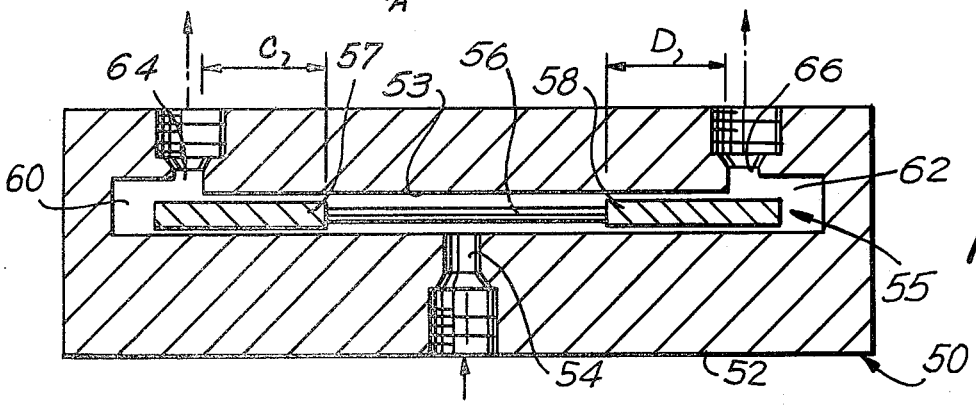
FIG. 3 shows a cross sectional view of a preferred form of a pressurization valve.

Shown in FIGS. 2 and 3 are preferred embodiments of depressurization valves and pressurization valves. The phantom lines 28 and 30 are representative of appropriate piping which may be employed to connect the press 10 to either or both the depressurization valve 32 of FIG. 2 or the pressurization valve 50 of FIG. 3.

Considering first the construction of the pressurization valve 50, this valve is comprised of a valve body member 52 having a bore 53 which extends longitudinally therein. An inlet port 54 communicates with the center portion of the bore 53. Slidably disposed within the bore 53 is a floating piston 55. The piston 55 has a center, reduced diameter portion 56 and end portions 57 and 58. Preferably, the bore 53 has a uniform diameter. The diameter of the end portions 57, 58 of the piston are slightly less than the diameter of the bore 53, i.e. the diameter of the portions 57, 58 of the piston is sized so as to define annular, flow restrictive passages between the wall of the portions 57, 58 and the valve body. More specifically, these flow restrictive passages are sized so as to insure that a pressure drop occurs when a fluid flows through the valve 50. Conversely, the diameter of the center portion 56 of the piston 55 is sized such that no substantial pressure drop occurs when fluid flows along the axial length of the center portion 56.

At the outward ends of the valve body 50 there are provided chambers 60, 62, which are enlarged diameter extensions of the bore 53. Outlet ports 64, 66 provide fluid communication with the chambers 60, 62, respectively. As suggested by the phantom line 70, 72, the outlet ports 64, 66 are piped to the ports 24, 26 of the press 10. When thus connected, the press 10 may be pressurized through the pressurization valve 50. During such pressurization, the pressurization valve 50 will function as follows.

The inlet port 54 is connected to a high pressure source not shown. As the pressurization fluid flows through the inlet port 54 into the bore 53, the flow stream will split and flow outwardly toward the chambers 60, 62. As will be seen from an inspection of FIG. 3, as the pressurization fluid flows between the portions 57 or 58 of the piston and the wall of the valve body, a pressure drop will occur since the portions 57 and 58, together with the valve body, define flow restrictive annuli. The pressure drop which occurs will be determined by the axial length of each of the flow restrictive passages, i.e. the position of the piston 55 in the valve body will determine the pressure drop experienced by each of the two flow streams. Additionally, it may be noted that movement of the piston 55 within the valve body will increase one of the pressure drops while decreasing the other pressure drop. For example, assume that initially the piston 55 is centered in the valve body 50 as shown in FIG. 3 and that a pressurization fluid is flowing outwardly toward the two chambers 60, 62. The pressure drop experienced by the flow stream going to the chamber 60 is determined by the axial distance C. Similarly, the axial distance D associated with the piston 58 defines the pressure drop experienced by the flow stream going from the inlet 54 to the chamber 62.

Let it now be assumed that the pressure in the chamber 62 increases in magnitude so as to be greater than the pressure in the chamber 60. As a result of this pressure difference, a force is exerted upon the piston 55 which will move the piston toward the chamber 60, i.e. toward the low pressure chamber. As a result of such movement, the distance C will be reduced and the distance D will be increased. As a result thereof, there will be an increase in the pressure drop experienced by the fluid flowing to the chamber 62 and a decrease in pressure drop experienced by the fluid flowing to the chamber 60. Therefore, the pressure in the chamber 60 will be increased and the pressure in the chamber 62 will be decreased. As such, it will be seen that the valve 50 is self-actuating and automatically adjusts the pressure in the chambers 60, 62 so as to be equal. Since the chambers 60, 62 are in direct fluid communication with the annular area 20 and the work area 18 of the press 10, it will be seen that the valve 50 functions to maintain a zero pressure difference across the mantle 16 during pressurization of the press 10.

Referring now to FIG. 2, there is shown a three port, self-actuating depressurization valve 32. The valve 32 is comprised of a valve body 34 having a floating piston 35 slidably disposed therein. More specifically, the valve body 34 includes an outlet port 36 which communicates with a transverse bore 37 which extends through the valve body 34. Preferably, the bore 37 has a uniform diameter. The bore 37 terminates at inlet ports 38, 39. The piston 35 has a diameter slightly less than the diameter of the bore 37 and is disposed within the bore 37 so as to slide freely back and forth. More specifically, the diameter of the piston 35 is selected so as to define a flow restrictive annulus between the wall of the piston 35 and the wall of the valve body 34 which defines the bore 37. As shown in FIG. 2, the piston 35 has an axial length less than the axial length of the bore 37. Thus, the ends of the piston 35 define chambers, each chamber being open at one side to a respective one of the ports 38, 39.

When the press 10 of FIG. 1 is to be depressurized, the ports 24, 26 are connected to the ports 38, 39 of the valve 32 as suggested by the phantom lines 74, 76 respectively. When the lines 74, 76 are connected, the outlet port 36 is then opened. Thereupon, the following action will occur. Assume that initially the piston 35 is in the axial center of the bore 37 and the pressure in the work area 18 is equal to the pressure in the annular area 20. Thus, the pressurizing fluid will flow through the ports 38, 39 and between the piston and the valve body wall, i.e. the pressurizing fluid will flow through the flow restrictive annulus defined by the piston and the valve body. Assume now that during the depressurization, the pressure in the annular area 20 drops faster than the pressure in the work area 18. As a result, the pressure at the port 38 will be lower than the pressure at the port 39. Therefore, a force will be exerted on the piston 35 which will move the piston 35 toward the low pressure port 38. The result of such movement will be to increase the axial length of the flow restrictive passage between the inlet port 38 and the outlet port 36. Simultaneously, the axial length of the flow restrictive passage between the port 39 and the outlet port 36 will be reduced. Therefore, fluid flowing from the port 38 to the port 36 will encounter a higher pressure drop while fluid flowing from the port 39 to the port 36 will encounter a lower pressure drop. As a result, the pressure at the port 39 will be decreased and the pressure at the port 39 will be increased, thereby equalizing the pressure in the annular area 20 and the work area 18. Such automatic self-adjusting of the piston 35 will continue during the depressurization process so as to maintain an equal pressure between the annular area 20 and the work area 18. Additionally, when either valve is connected to a pressure vessel, pressure equalization is maintained.

Although the pressurization and depressurization valves hereinbefore described have been shown as being separate and apart from the pressure vessel to which they are connected, it should be noted that such valves may be constructed as an integral part of the vessel, e.g. as an integral part of one of the end closure members.

Typically, a pressurization or depressurization valve constructed in accordance with this invention will include a piston having an outer diameter of approximately 0.25 inches to 2 inches and the thickness of the flow control annuli will be in the range of approximately 0.002 inches to 0.025 inches.

Although preferred embodiments of this invention have hereinbefore been described, it will be appreciated that other embodiments of this invention may be perceived without departing from the scope of the invention as defined by the claims appended hereto.

I claim:

1. In combination with an isostatic press adapted for hot isostatic pressing and including a cylindrical mantle which define a work area and an annulus between said mantle and the wall of said press, the improvement which comprises:

a. first and second ports in said press providing fluid communication to said work area and said annulus;

b. a three port pressure equalizing valve;

c. means providing fluid communication between said first and second ports and respective ports of said valve.

2. The combination of claim 1 wherein said valve is a depressurizing valve.

3. The combination of claim 1 wherein said valve is a pressurizing valve.

4. In combination with a pressure vessel having heating elements within the vessel and a heat shield interposed between said heating elements and the wall of said vessel, the improvement which comprises a pressure equalizing valve having a first port in fluid communication with the annular space between said shield and said vessel wall, a second port in fluid communication with the interior portion of said vessel located inwardly of said shield, a third port in fluid communication with said first and second ports, and means for varying the fluid flow resistance between said first and third ports and between said second and third ports, said means being responsive to the pressure difference between said first and second ports.

5. The improved pressure vessel of claim 4 wherein said valve comprises:

a. a housing having a chamber therein, said ports being in fluid communication with said chamber; and b. a piston slidably mounted in said chamber, the position of said piston in said chamber being determined by the pressure difference between said first and second ports and the position of said piston in said chamber controlling the pressure drop experienced by fluid flowing between each of said first and second ports and said third port.

6. In combination with an isostatic press adapted for hot isostatic pressing and including a cylindrical mantle which defines a work area and an annulus between said mantle and the wall of said press, the improvement which comprises:

a. first and second ports in said press and providing fluid communication to said work area and said annulus, respectively;

b. a valve body having two outer ports and an intermediate port;

c. fluid communication means connecting said first and second ports with a respective one of said outer ports; and d. a valve member disposed within said valve body and together with said valve body defining restrictive flow control paths between said intermediate port and each of said outer ports, the length of said paths being determined by the position of said member in said body, said member being disposed within said body so as to move toward the outer port having the lowest pressure.

7. The combination of claim 6 wherein said outer ports are outlet ports and said intermediate port is an inlet port.

8. The combination of claim 6 wherein said outer ports are inlet ports and said intermediate port is an outlet port.

* * * * *